US012427623B2

(12) United States Patent
Riker

(10) Patent No.: US 12,427,623 B2
(45) Date of Patent: Sep. 30, 2025

(54) SANDING SYSTEM FOR A CONSTRUCTION TOOL

(71) Applicant: Madaizel Tool Company, West Olive, MI (US)

(72) Inventor: Landon Riker, West Olive, MI (US)

(73) Assignee: Madaizel Tool Company, West Olive, MI (US)

( * ) Notice: Subject to any disclaimer, the term of this patent is extended or adjusted under 35 U.S.C. 154(b) by 633 days.

(21) Appl. No.: 17/841,828

(22) Filed: Jun. 16, 2022

(65) Prior Publication Data

US 2023/0405763 A1 Dec. 21, 2023

(51) Int. Cl.
*B24B 55/10* (2006.01)
*B24B 23/04* (2006.01)

(52) U.S. Cl.
CPC ..... *B24B 55/10* (2013.01); *B24B 23/04* (2013.01)

(58) Field of Classification Search
CPC ..... B24B 55/105; B24B 55/10; B24B 7/184; B24D 15/02; B24D 15/023; B24D 15/04
USPC ..... 451/354, 456, 457, 502, 503, 524, 523
See application file for complete search history.

(56) References Cited

U.S. PATENT DOCUMENTS 3,914,906 A 10/1975 Barnes
4,287,685 A * 9/1981 Marton ..... B24B 55/102 451/514
4,839,995 A * 6/1989 Hutchins ..... B24B 23/04 451/357
4,893,437 A 1/1990 Doherty
4,905,420 A * 3/1990 Flachenecker ..... B24B 55/105 451/344
5,345,724 A 9/1994 Ng, Jr.
6,120,363 A 9/2000 Dunn
6,325,708 B1 12/2001 Miles
7,033,259 B1 * 4/2006 Seasholtz ..... B24D 15/023 451/354
7,264,541 B1 9/2007 Ray et al.
7,285,038 B1 10/2007 Jioia
7,364,500 B2 * 4/2008 Brown ..... B24D 15/04 451/523
7,485,031 B1 2/2009 Stubbs
7,779,500 B1 8/2010 Greer
2001/0000503 A1 4/2001 Beaudry et al.
2002/0016143 A1 2/2002 Bosten et al.
2006/0135049 A1 6/2006 Petersen et al.
2009/0047882 A1 2/2009 Collins
2009/0124177 A1 5/2009 Berryhill
2009/0181607 A1 7/2009 Ray, Jr.
(Continued)

*Primary Examiner* — Makena S Markman
(74) *Attorney, Agent, or Firm* — Gardner, Linn, Burkhart & Ondersma LLP

(57) ABSTRACT

A sanding system for sanding a working surface includes a vacuum portion having spaced-apart first and second inlets for recovering debris produced from the sanding process. A sanding portion is reciprocated relative to the vacuum portion to sand the working surface. As the sanding portion moves, it alternatively covers and uncovers the first and second inlets so that only one inlet is uncovered at a time. The uncovered inlet thus directs increased suction force towards the working surface to more effectively recover sanding debris. Optionally, an alignment heel is coupled in a spaced and aligned arrangement relative to the sanding portion to promote stability and uniform contact pressure between the sanding portion and the working surface.

17 Claims, 9 Drawing Sheets

(56) References Cited

U.S. PATENT DOCUMENTS

| | | | | |
|---|---|---|---|---|
| 2009/0247058 | A1 | 10/2009 | Lamers | |
| 2011/0159790 | A1 | 6/2011 | Wilson | |
| 2011/0312250 | A1 | 12/2011 | Wilson | |
| 2012/0322350 | A1 | 12/2012 | Schywalsky | |
| 2013/0055577 | A1 | 3/2013 | Jensen et al. | |
| 2013/0205519 | A1 | 8/2013 | Steele et al. | |
| 2013/0260656 | A1* | 10/2013 | Seth | C09K 3/1409 51/296 |
| 2013/0267149 | A1 | 10/2013 | Rocha | |
| 2021/0276154 | A1* | 9/2021 | Siebert | B24B 55/10 |

* cited by examiner

SANDING SYSTEM FOR A CONSTRUCTION TOOL

FIELD OF THE INVENTION

The present invention relates generally to construction tools and tool accessories, and particularly to tools and tool accessories adapted to sand or smooth a surface.

BACKGROUND OF THE INVENTION

Many construction applications require sanding or smoothing a working surface, such as the surface of a wooden board or the surface of drywall compound at a seam between adjacent drywall panels. The sanding process involves placing an abrasive article, such as a sanding sheet or block, into contact with the working surface, and then moving the abrasive article to level or smooth portions of the working surface by removing material from the working surface. It can be beneficial to maintain a desired angle of contact between the abrasive article and working surfaces while sanding to avoid inadvertently creating gouges or other noticeable imperfections in the working surface. Material removed from the working surface may take the form of particulate matter which can permeate through the surrounding environment, often times coming to rest on undesired nearby non-working surfaces, such as countertops or furniture.

SUMMARY OF THE INVENTION

The sanding system of the present invention is adapted to be attached or incorporated into a powered self-moving tool, such as an electric reciprocating power tool, that actuates a sanding portion of the sanding system to sand or smooth a working surface, such as a wooden board or cured drywall compound located along a seam (such as at an inside corner) between adjacent drywall panels. A vacuum portion defines a pair of spaced apart inlets that recover dust and debris produced from the sanding process. While sanding, the sanding portion is moved to cover one inlet at a time, leaving the other inlet uncovered. As a result, the location of the uncovered inlet continuously alternates between the locations of each inlet. Because at least one inlet is always covered, the uncovered inlet will have increased suction power, thus resulting in effective recovery of dust and debris from continuously alternating areas of the working surface. An alignment heel that is spaced apart from the sanding and vacuum portions can be moved along the working surface to ensure proper contact and uniform pressure is maintained between the sanding portion and the working surface to reduce the likelihood of inadvertently creating gouges or other imperfections during the sanding process.

According to one form of the invention, a sanding system for sanding a working surface includes a vacuum portion having first and second vacuum inlets that direct a suction force to recover dust and debris from the working surface being sanded. A sanding portion to which an abrasive article (such as sandpaper) may be secured is movable relative to the vacuum portion between first and second positions. In the first position, the first vacuum inlet is at least partially covered by the sanding portion and the second vacuum inlet is at least partially uncovered, and in the second position the second vacuum inlet is at least partially covered by the sanding portion and the first vacuum inlet is at least partially uncovered.

In one aspect, the sanding portion includes a pair of backing surfaces oriented at an angle relative to one another and connected along a longitudinal axis. Optionally, the backing surfaces are oriented at a 90 degree angle relative to one another to more effectively sand adjacent surfaces at and/or near an internal corner.

In another aspect, the backing surfaces include tapered portions that are oriented at an angle of less than 90 degrees relative to one another.

In yet another aspect, the first and second vacuum inlets are located entirely inboard of the sanding portion in both latitudinal and transverse directions.

In still another aspect, the sanding system includes an attachment that protrudes through a hole defined by the vacuum portion to connect the sanding portion to a reciprocating part of a reciprocating power tool.

In a further aspect, the vacuum portion may be secured to a non-reciprocating part of the reciprocating power tool.

In yet a further aspect, the sanding system includes an alignment heel that is spaced apart from the sanding and vacuum portions, and is secured to the non-reciprocating part of the power tool. The alignment heel slides along the working surface during the sanding process to aid in maintaining a desired alignment and uniform pressure between the sanding portion and the working surface. The alignment heel and the sanding portion each terminate along a common longitudinal axis. Optionally, the alignment heel includes a pair of surface guides angled relative to one another and connected along the common longitudinal axis. Additionally, the surface guides may have the same angle relative to one another as the backing surfaces have relative to one another, such as 90 degrees.

According to another form of the invention, a sanding system for sanding a working surface includes an alignment heel with a surface guide that may slide along the working surface substantially without removing material from the working surface. The alignment heel is spaced apart from and coupled to a sanding portion having a backing surface, where the sanding portion is used to sand the working surface. Both the surface guide and the backing surface are coplanar in a contact plane.

In one aspect, the surface guide includes a pair of surface guides angled relative to one another and connected along a common longitudinal axis.

In another aspect, the sanding portion includes a pair of backing surfaces angled relative to one another and connected along the common longitudinal axis. The backing surfaces may have the same angle relative to one another as the surface guides have relative to one another, which may optionally be 90 degrees, such that both the backing surfaces and the surface guides make slidable contact with a pair of adjacent surfaces at and/or near an internal corner.

In yet another aspect, the surface guide is a felt surface that slides along the working surface.

In still another aspect, the alignment heel may be attached to a non-moving portion of a power tool, and the sanding portion may be attached to a moving portion of the power tool.

In a further aspect, the alignment heel includes a retention feature that frictionally engages with the non-moving portion of the power tool to secure the power tool to the alignment heel.

Thus, the sanding system of the present invention provides an effective way to sand a working surface, such as dried drywall compound or "mud" located along a wall seam. The sanding system includes a sanding portion that moves relative to a vacuum portion to cover and uncover one vacuum inlet at a time in an alternating fashion, the vacuum portion having a pair inlets spaced apart from one another. This results in increased suction power at alternating positions (the position of each inlet) to more effectively recover dust and debris from the working surface. The precision and quality of the sanding process is enhanced by an alignment heel spaced from the sanding and vacuum portions. The alignment heel slidably contacts the working surface to improve the stability and alignment of the sanding portion relative to the working surface, thereby reducing the likelihood of creating inadvertent gouges or other imperfections in the working surface due to uneven contact or pressure between the sanding portion and the working surface.

These and other objects, advantages, purposes and features of the present invention will become apparent upon review of the following specification in conjunction with the drawings.

DETAILED DESCRIPTION OF THE PREFERRED EMBODIMENTS

Figure 1:
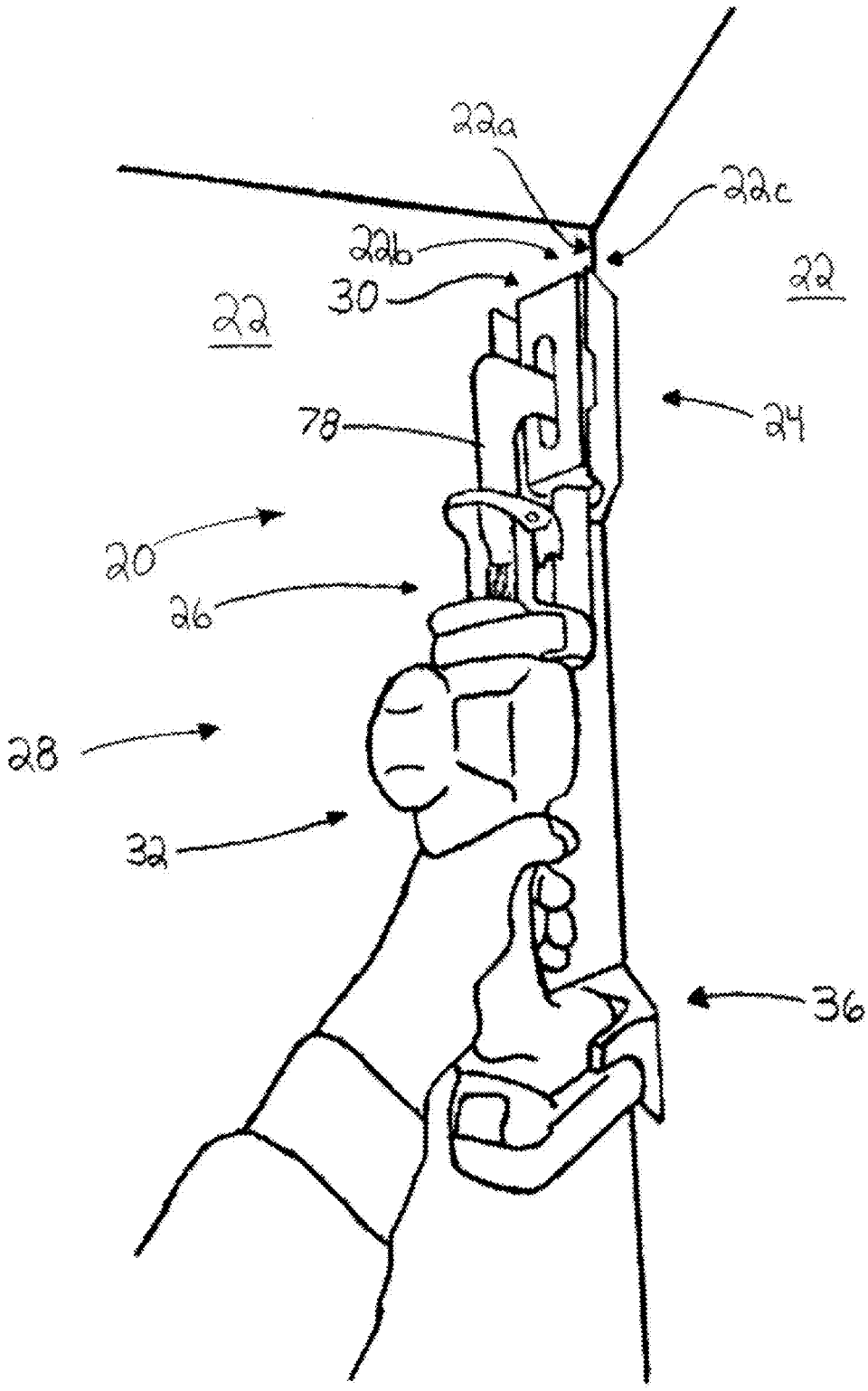
FIG. 1 is a rear perspective view of a sanding system in accordance with the present invention, with the sanding system shown attached to a reciprocating power tool and being used to sand a wall corner.
Figure 7A:
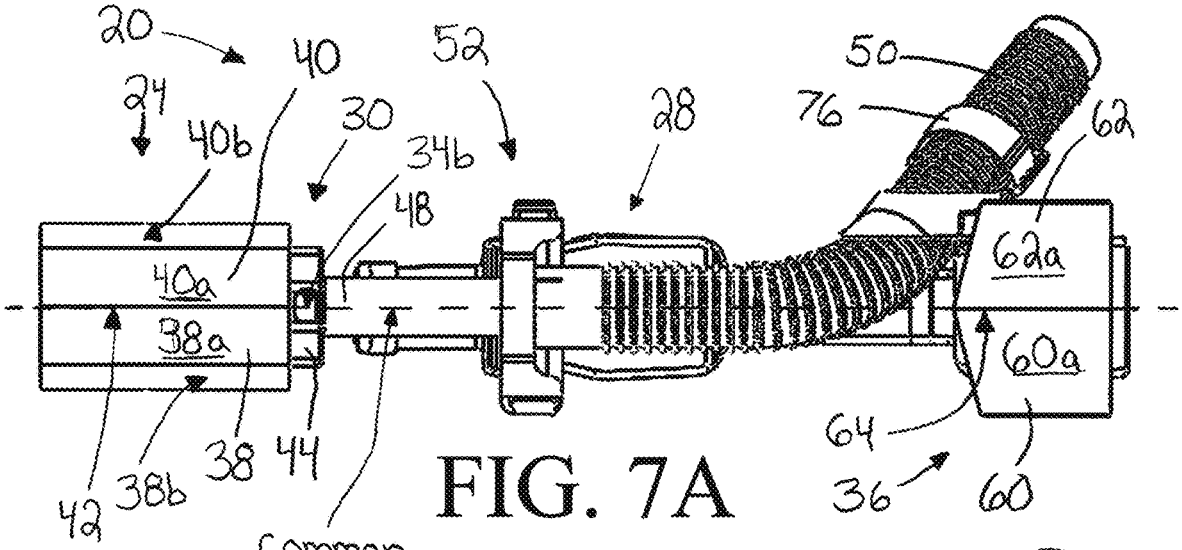
FIG. 7A is a bottom plan view of the sanding system of FIG. 6A.
Figure 7B:
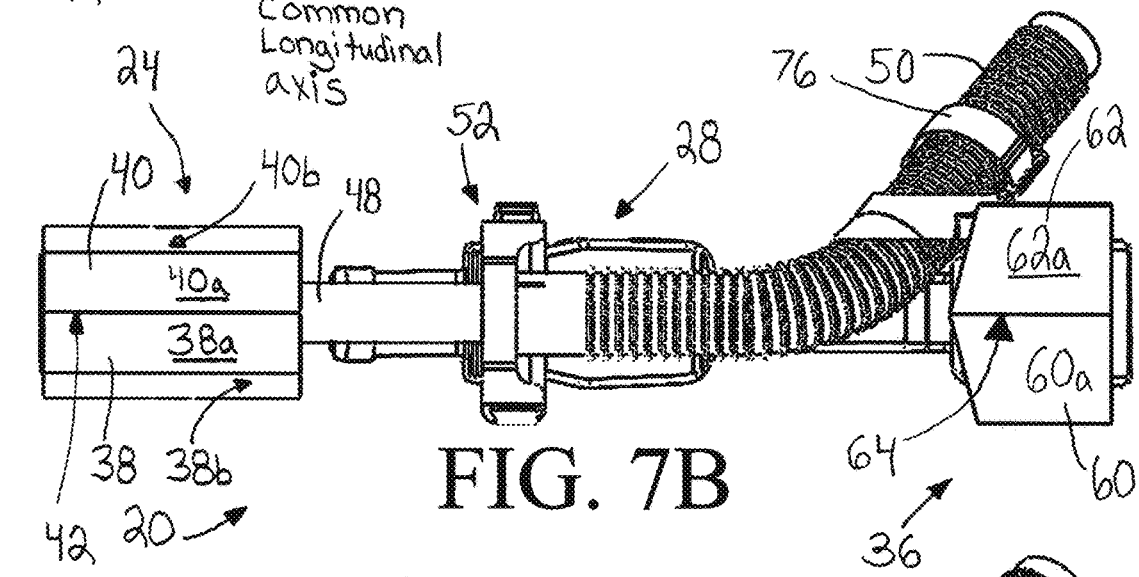
FIG. 7B is a bottom plan view of the sanding system of FIG. 6B.
Figure 7C:
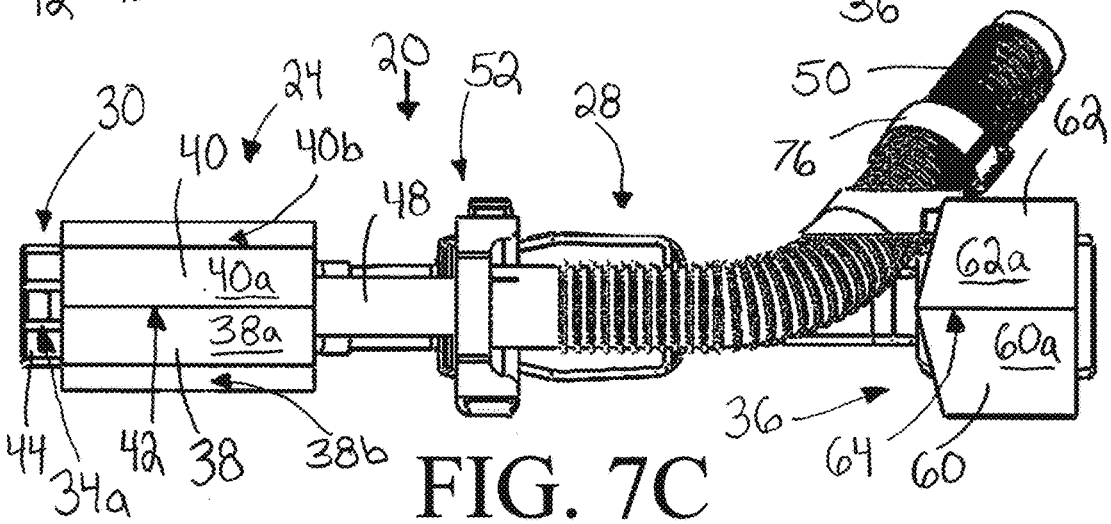
FIG. 7C is a bottom plan view of the sanding system of FIG. 6C.
Figure 8:
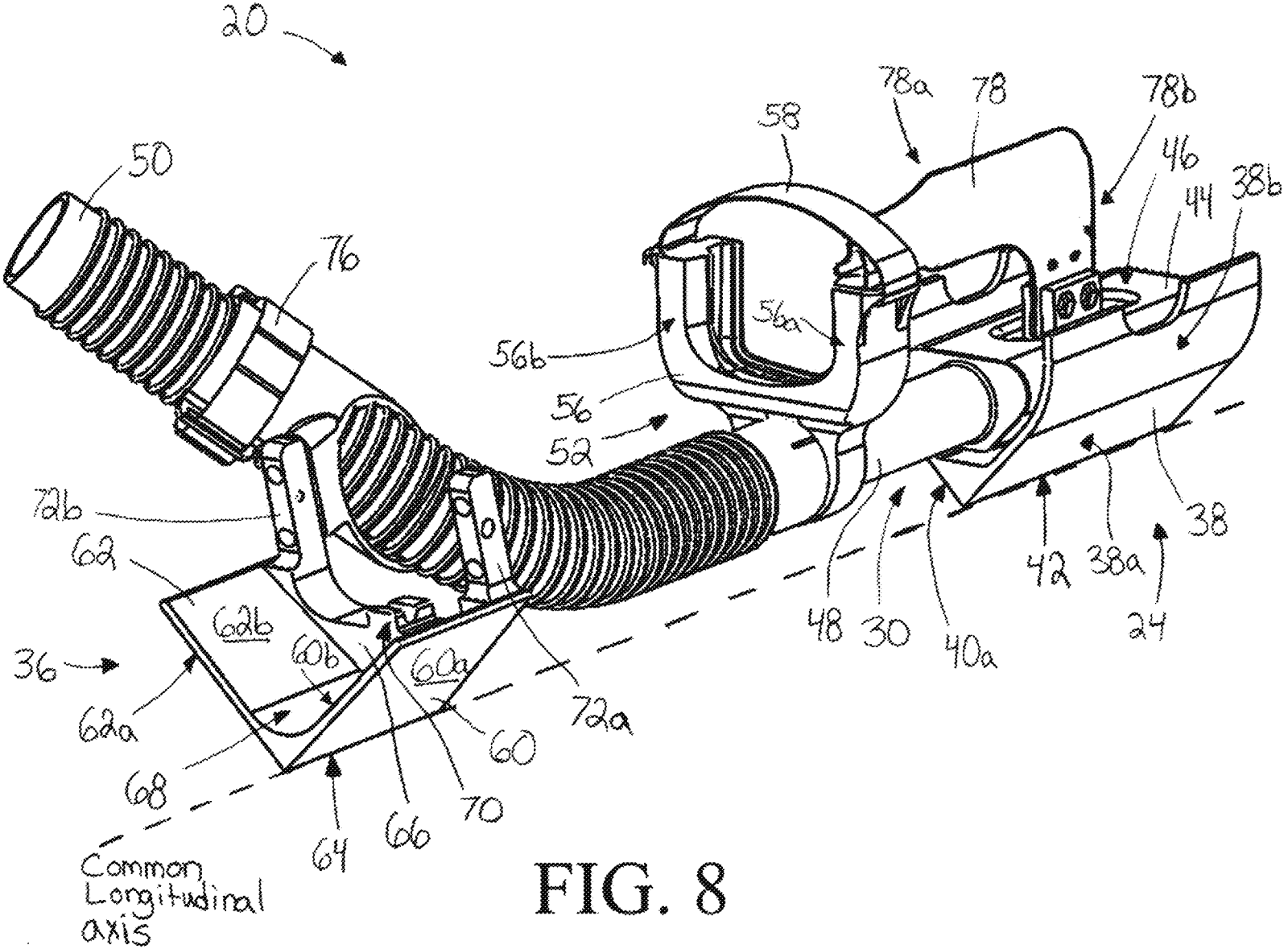
FIG. 8 is rear perspective view of the sanding system of FIG. 1, shown without the reciprocating power tool.
Figure 9:
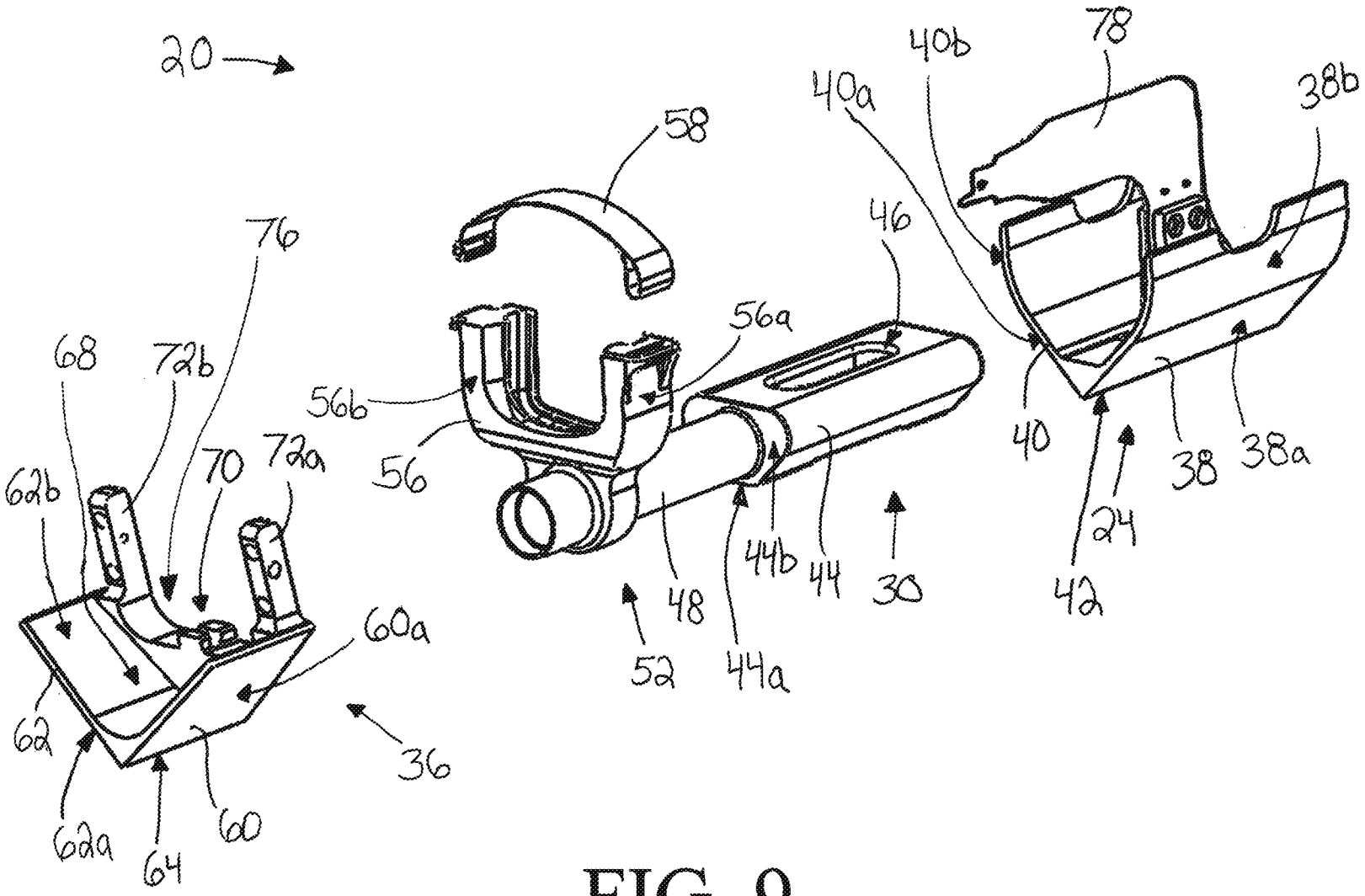
FIG. 9 is an exploded rear perspective view of the sanding system of FIG. 8, without a vacuum hose.
Figure 10:
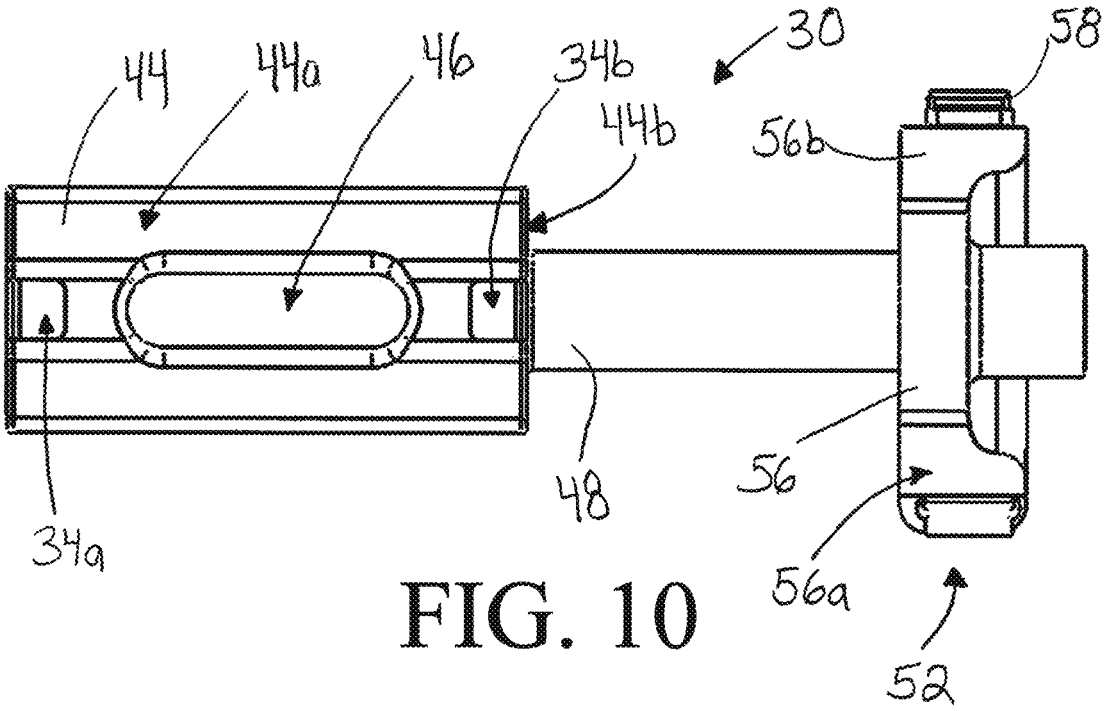
FIG. 10 is a bottom plan view of a vacuum portion of the sanding system of FIG. 1.
Figure 11:
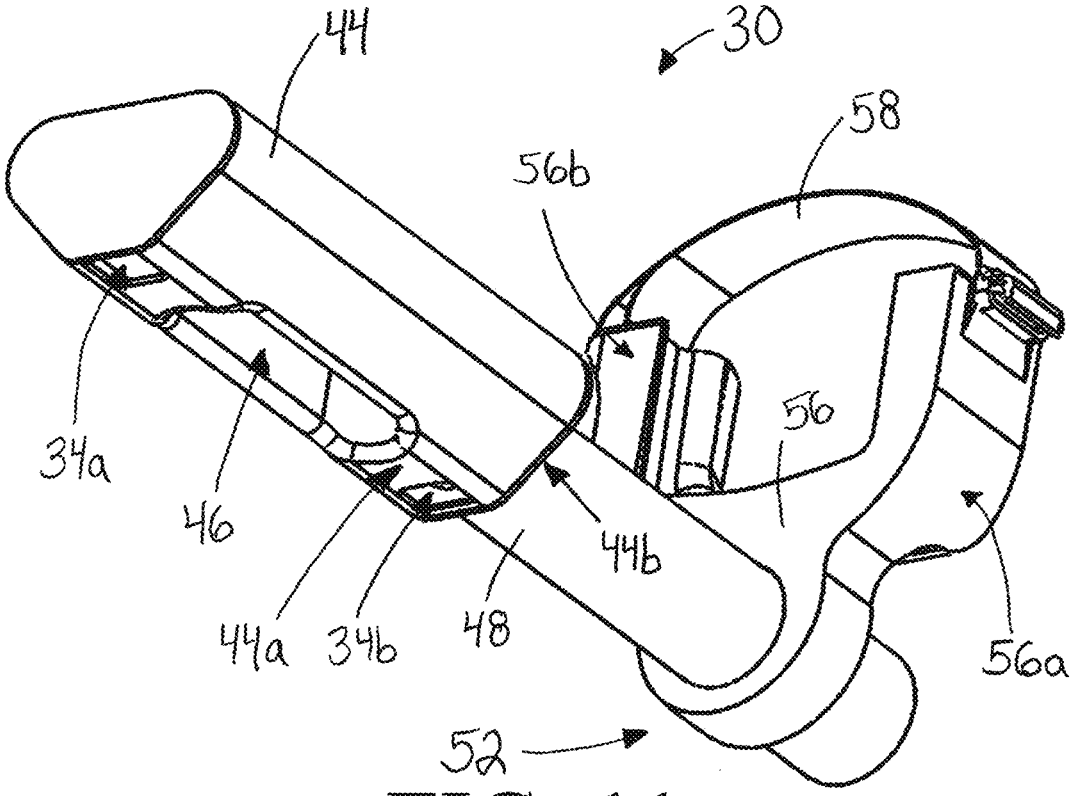
FIG. 11 is a lower perspective view of the vacuum portion of FIG. 10.

Referring now to the drawings and the illustrative embodiments depicted therein, a sanding system 20 is adapted to uniformly sand and recover sanding debris from a working surface such as the surface of a wall 22 shown in FIG. 1. A sanding portion 24 provides an area for securing an abrasive article, such as sandpaper, and is attachable to a reciprocating part 26 of a reciprocating power tool 28. Power tool 28 reciprocates sanding portion 24 against the surfaces of wall 22 to smooth and flatten portions of wall 22 by abrading or removing excess material forming ridges, bumps, or other protrusions extending outward from wall 22. A vacuum portion 30 attached to a non-reciprocating part 32 of power tool 28 defines a pair of spaced apart inlets 34*a*, 34*b* (FIGS. 10 and 11) for suctioning sanding debris from wall 22. Inlets 34*a*, 34*b* are individually and alternatively covered and uncovered by sanding portion 24 as it reciprocates, such as shown in FIGS. 7A and 7C, to allow for the more effective removal of sanding debris from wall 22. An alignment heel 36, also connected to the non-reciprocating part 32 of power tool 28, is spaced apart from both sanding and vacuum portions 24, 30 and slides along the surface of wall 22 to facilitate proper alignment and even pressure between sanding portion 24 and wall 22, thereby reducing the likelihood of inadvertently creating undesirable gouges and other imperfections on wall 22.

Referring now to FIGS. 2-4, 8, and 9, sanding portion 24 includes a pair of backing surfaces or pads 38, 40 that are angled relative to one another at a sanding angle and connected at a sanding tip 42 extending along a common longitudinal axis. Pads 38, 40 are oriented at an approximately 90 degree angle relative to one another at contact portions 38*a*, 40*a* that meet to define tip 42 to allow sanding portion 24 to effectively sand internal corners, such as internal corner 22*a* of wall 22 shown in FIG. 1. Tapered end portions 38*b*, 40*b* of pads 38, 40 are oriented at less than a 90 degree angle relative to one another to ensure tip 42 and contact portions 38*a*, 40*a* are unobstructed to reach and make full contact with corner 22*a* and proximate adjacent portions 22*b*, 22*c* of wall 22. An abrasive article, such as a sheet of sandpaper, can be secured to pads 38, 40 through various methods including hook and loop fastening features or spring-loaded clamps. It will be appreciated that backing pads having varying geometric profiles for sanding other surface areas may be utilized in sanding system 20. For example, a single planar backing pad could be used to sand a flat portion of wall 22 not located near a corner.

Vacuum portion 30 includes an enclosure 44 located inboard of sanding portion 24 in both a latitudinal direction and a transverse direction, such as shown in FIGS. 2-4 and 8-11. A distal side 44*a* of enclosure 44 defines forward inlet 34*a* and rearward inlet 34*b* in a spaced arrangement, where inlets 34*a*, 34*b* are fluidly connected to an interior volume of enclosure 44. Inlets 34*a*, 34*b* share a common latitudinal plane with the common longitudinal axis of sanding tip 42, discussed above, such that inlets 34*a*, 34*b* are centered with respect to sanding portion 24 in the transverse direction (FIGS. 7A and 7B). An elongated through-hole or access hole 46 extends through enclosure 44 in the latitudinal direction and is not fluidly connected to the interior volume of enclosure 44. A posterior side 44*b* of enclosure 44 is fluidly connected to a rigid elongated tube or duct 48. Duct 48 may be connected to a vacuum via a vacuum tube or hose 50 to fluidly connect vacuum portion 30 to the vacuum. Duct 48 is secured to a connector 52 by extending through a receiving hole defined by connector 52. Connector 52 includes a U-shaped shoulder 56 and an adjustable strap 58 that can be selectively secured and detached between a pair of arms 56*a*, 56*b* of shoulder 56. Non-reciprocating part 32 of power tool 28 can be received by shoulder 56 and secured in place by strap 58 to attach vacuum portion 30 to non-reciprocating part 32 of power tool 28. It should be appreciated that a vacuum portion may include more than one enclosure, in which each enclosure may define one or more inlets. Additionally, a vacuum hose may be routed along and/or adjacent to a shoulder and/or a connector.

With reference to FIGS. 2, 4, 5, 8, and 9, alignment heel 36 includes a pair of surface guides 60, 62 that are angled relative to one another at a guide angle and meet to define a guide tip 64 extending along the common longitudinal axis that is shared by tip 42 of sanding portion 24 as discussed above. Guides 60, 62 are oriented at an approximately 90 degree angle relative to one another such that outer sides 60*a*, 62*a* of each guide 60, 62 can fully engage with and slide along wall portions 22*b*, 22*c* and corner 22*a* of wall 22. Guides 60, 62 also have inner sides 60*b*, 62*b* that are connected to an upright anterior portion 66 to collectively define a saddle 68 or receiving area for part of non-reciprocating part 32 of power tool 28, such as a removable battery attachment. It should be understood that surface guides may curve and/or transition in a non-linear fashion to meet and form a curved and/or truncated guide tip within the scope of the present invention, such that the guide tip may take the form of a rounded fillet or chamfer, for example. Likewise, it should also be understood that backing surfaces of a sanding portion may meet to form a sanding tip in a similar or identical fashion. A protrusion or outwardly extending feature of power tool 28 may be secured to anterior portion 66 via frictional engagement with a retention cavity 70 to secure power tool 28 to alignment heel 36. The frictional engagement of the protrusion or outwardly extending feature of power tool 28 in retention cavity 70 may be similar to that of a press fit connection, or may be easily releasable by a user. In alternative embodiments, an alignment heel may include one or more retention cavities having geometry that differs from retention cavity 70, or may include one or more protrusions to engage with varying geometric characteristics of different power tools.

Anterior portion 66 also includes a pair of upright supports 72*a*, 72*b* located on opposite sides of retention cavity 70. Supports 72*a*, 72*b* each define a pair of bolt holes 74 for securing a hose mount 76 that supports and directs vacuum hose 50 away from power tool 28 and sanding system 24 to limit potential interference or obstruction by vacuum hose 50 in the sanding process. Hose mount 76 may be secured to either support 72*a*, 72*b* depending on a user's preference. Alternatively, a clamp or clip fastener could be used to secure vacuum hose 50 to alignment heel 36.

Figure 2:
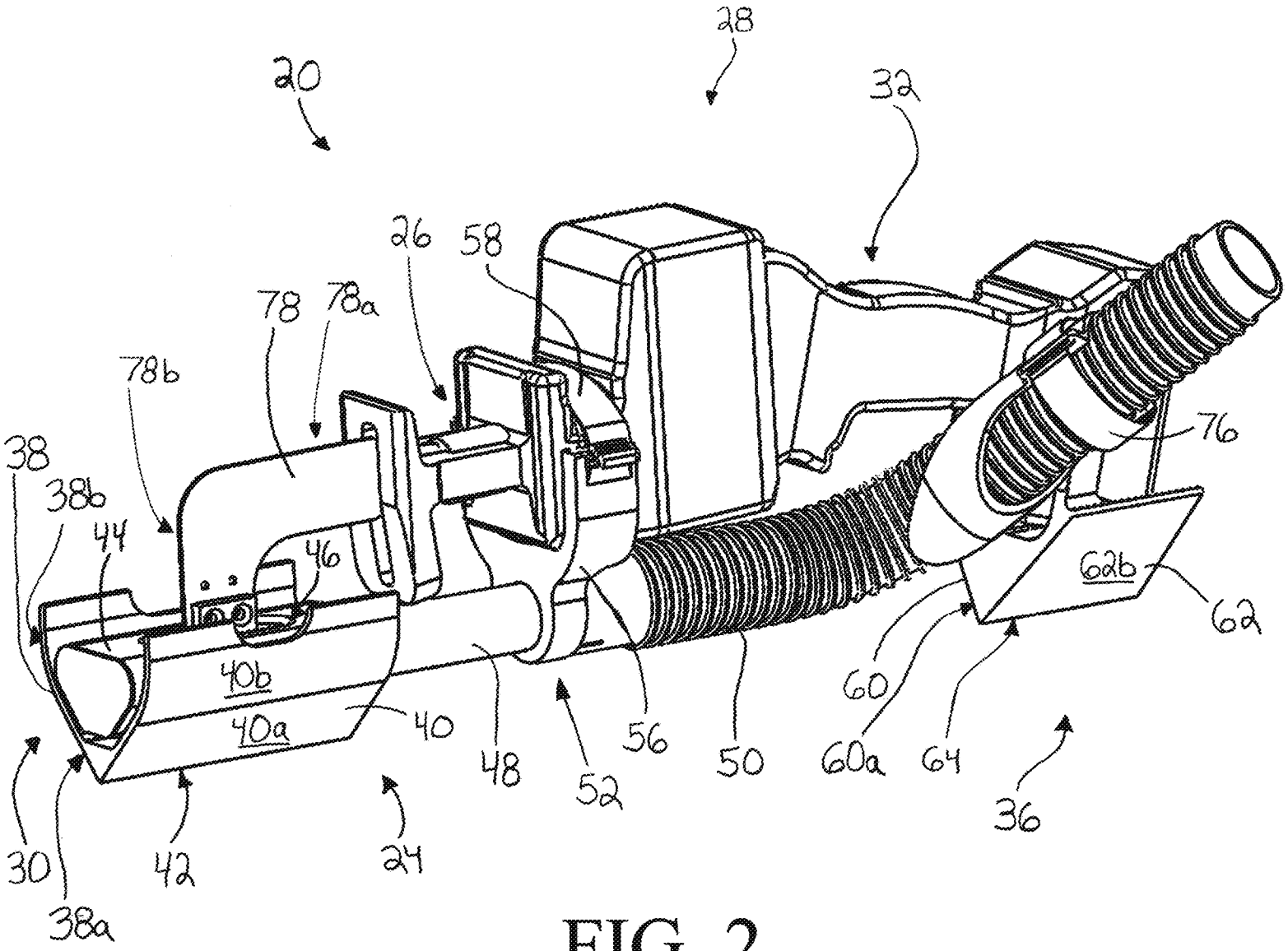
FIG. 2 is a front perspective view of the sanding system of FIG. 1.
Figure 3:
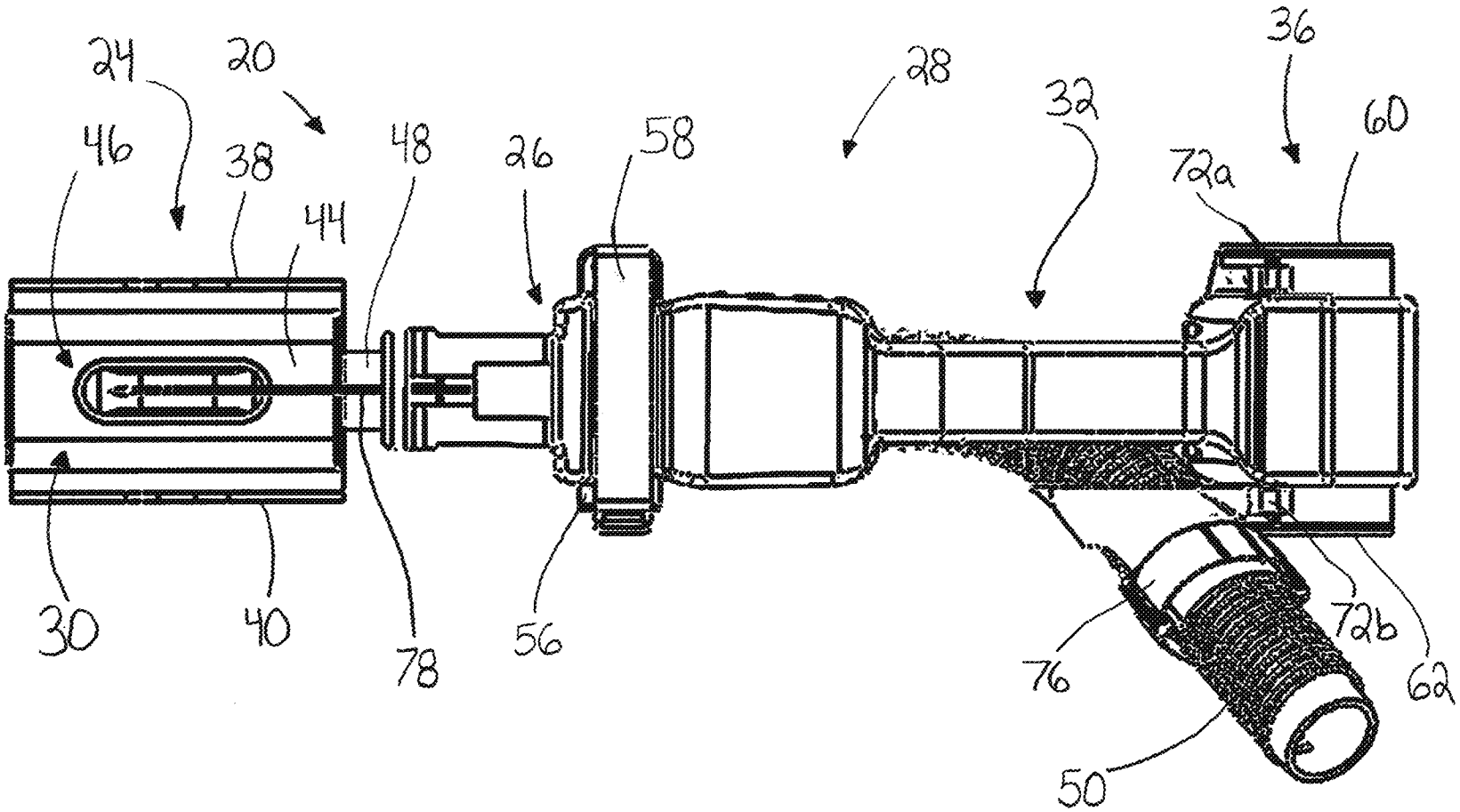
FIG. 3 is a top plan view of the sanding system of FIG. 1.

As shown in FIGS. 2 and 3, sanding portion 24 is selectively attachable to reciprocating part 26 of power tool 28 via an attachment in the form of a curved shank 78. Curved shank 78 has a longitudinal leg 78*a* and a latitudinal leg 78*b*, the latter extending through access hole 46 to connect to sanding portion 24. Latitudinal leg 78*b* includes a series of latitudinally spaced-apart connective features in the form of through-holes or threaded through-holes configured to receive a threaded bolt (which may be inserted and/or threaded through the through-holes into a nut) to allow sanding portion 24 to be secured to latitudinal leg 78*b* at various latitudinal locations depending on user preference. It will be understood that a curved shank or attachment may vary depending on the configuration or type of tool to which a sanding portion is being attached, or the varying characteristics of a sanding portion itself. Reciprocating part 26 of power tool 28 is typically powered by an electromechanical or pneumatic force (such as is provided by a battery, an electrical outlet, or an air compressor, for example) to move back and forth in a longitudinal direction. The reciprocating movement of reciprocating part 26 similarly causes shank 78 to reciprocate in the longitudinal direction, where access hole 46 is elongated in the longitudinal direction to accommodate the reciprocating motion of latitudinal leg 78*b*. The reciprocating motion of shank 78 is transferred to sanding portion 24, thus enabling sanding portion 24 to reciprocate against a surface in order to sand, smooth, and/or flatten portions of the surface. It should be appreciated that an attachment may be secured to a sanding tool in a manner that varies from what has been described above. For example, an enclosure may include one or more connective features to which an attachment may be secured, such that the attachment would still secure a sanding portion to a reciprocating portion of a power tool.

Figure 6A:
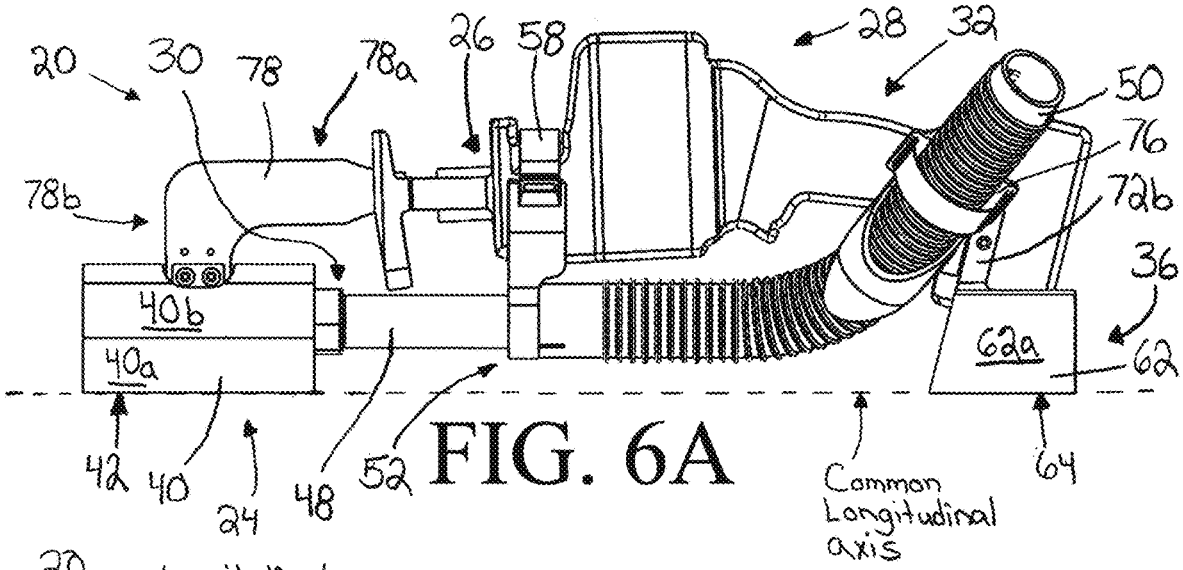
FIG. 6A is a left side elevation view of the sanding system of FIG. 1, with a sanding portion located in a forward position.
Figure 6B:
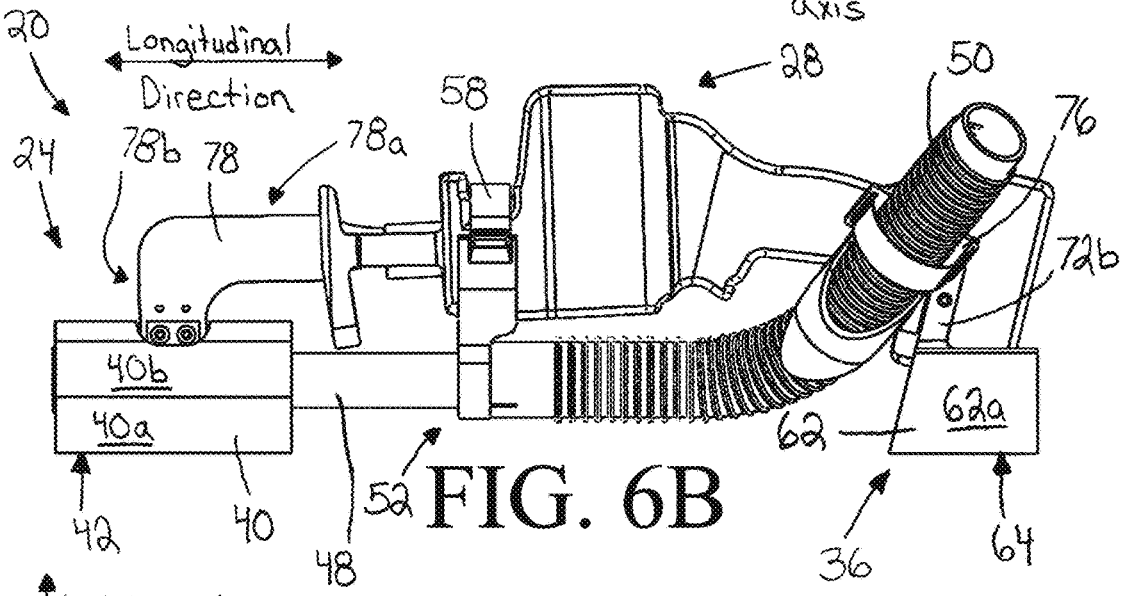
FIG. 6B is the sanding system of FIG. 6A, with the sanding portion located in a center position.
Figure 6C:
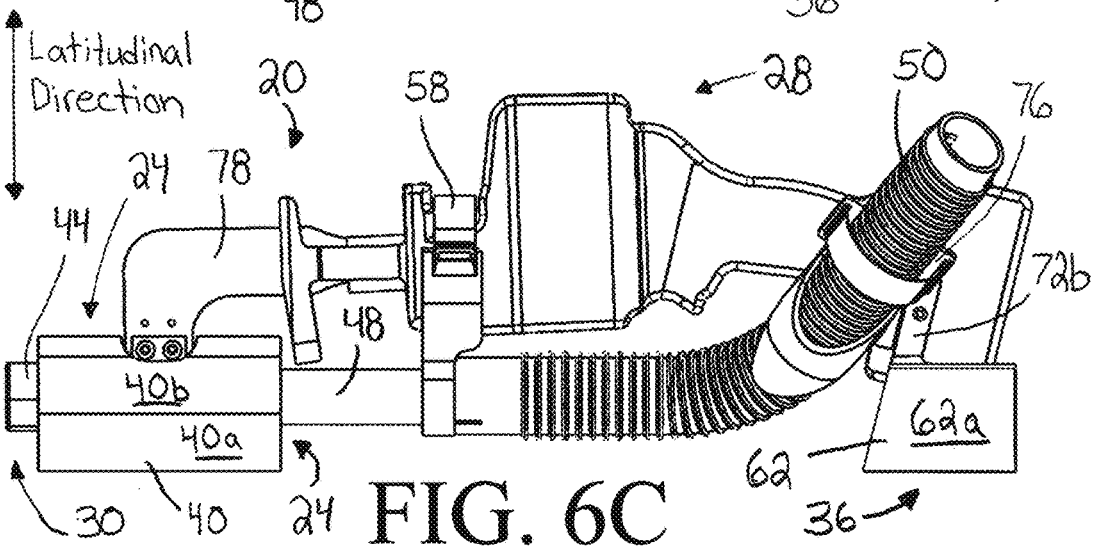
FIG. 6C is the sanding system of FIG. 6A, with the sanding portion located in a rearward position.

Sanding portion 24 reciprocates through a neutral or central position (FIGS. 6B and 7B), a first or forward position (FIGS. 6A and 7A), and a second or rearward position (FIGS. 6C and 7C) relative to vacuum portion 30 while sanding wall 22. In the central position of FIGS. 6B and 7B, both inlets 34*a*, 34*b* are covered. In the forward position of FIGS. 6A and 7A, forward inlet 34*a* is covered and rearward inlet 34*b* is uncovered. In the rearward position of FIGS. 6C and 7C, forward inlet 34*a* is uncovered and rearward inlet 34*b* is covered. Accordingly, forward inlet 34*a* or rearward inlet 34*b* may be covered by sanding portion 24, where the uncovered inlet 34*a* or 34*b* alternates depending on whether sanding portion is in the forward position or the rearward position. As a result, the majority of the suction force generated by a vacuum attached to vacuum portion 30 will be imparted through only a single inlet 34*a* or 34*b* while sanding portion 24 is in the forward or rearward position, thus resulting in increased suction power through the uncovered inlet as compared to if both inlets 34*a*, 34*b* were uncovered.

Because inlets 34*a*, 34*b* are spaced apart near opposing ends of enclosure 44, the suction force is rapidly and continuously redirected between alternating locations based on the frequency of reciprocation of sanding portion 24. These characteristics result in increased suction power at both inlets 34*a*, 34*b* to more effectively recover dust and debris from the working surface as the user is sanding the working surface. Material abraded away or otherwise separated from the working surface during the sanding process is suctioned or vacuumed into inlets 34*a*, 34*b* to enter enclosure 44. From enclosure 44, the material moves through duct 48 and then vacuum hose 50. Vacuum hose 50 may be fluidly connected to a vacuum such as a shop vacuum having a reservoir to store recovered material. It should be appreciated that an alternative vacuum portion may include more than two inlets and/or inlets that are arranged in a different configuration such that a sanding portion still moves to alternatively cover and uncover one or more inlets at various locations.

Figure 4:
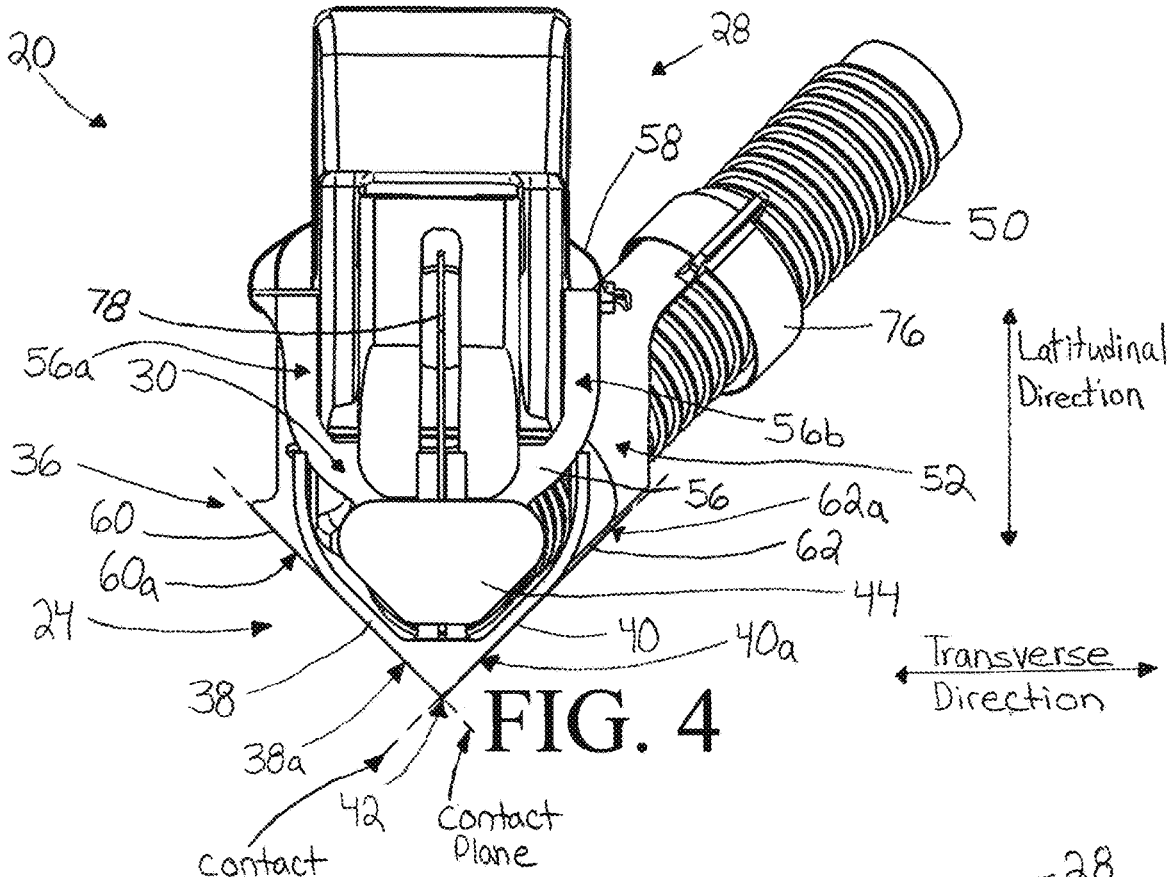
FIG. 4 is a front elevation view of the sanding system of FIG. 1.
Figure 5:
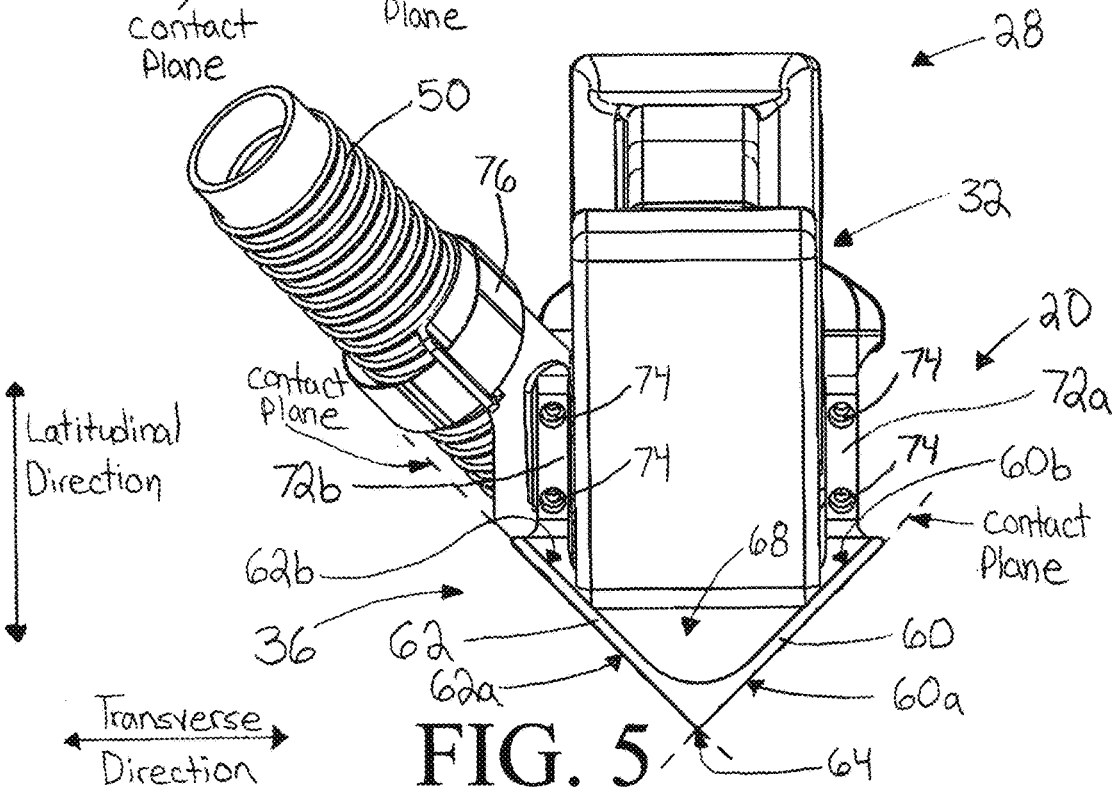
FIG. 5 is a rear elevation view of the sanding system of FIG. 1.

The above-described debris collection process is achieved in part due to the position of vacuum portion 30 relative to sanding portion 24. As previously noted, enclosure 44 is located inboard of sanding portion 24 in both the latitudinal direction and the transverse direction, and inlets 34*a*, 34*b* are defined by distal side 44*a* of enclosure 44. As shown in FIGS. 2 and 4, distal side 44*a* of enclosure 44 is slightly spaced from sanding portion 24 such that pads 38, 40 do not make physical contact with inlets 34*a*, 34*b*. Therefore, sanding portion 24 moves to cyclically cover and uncover the inlets 34*a*, 34*b* in an alternating fashion. Although FIGS. 7A-7C show that one or both inlets 34*a*, 34*b* are covered or obscured by sanding portion 24 at different positions, the inlets are not necessarily sealed closed, such that there can be continuous airflow through inlets 34*a*, 34*b* even when covered or partially covered. Thus, inlets 34*a*, 34*b* are considered to be substantially covered when at least a majority of their surface areas are covered or overlaid by sanding portion 24, even though there may be continuous airflow into the inlets 34*a*, 34*b* when so covered. Likewise, inlets 34*a*, 34*b* are substantially uncovered when a majority of their surface areas are uncovered or not overlaid by sanding portion 24. These characteristics improve the effectiveness of debris recovery by inlets 34*a*, 34*b* in part because inlets 34*a*, 34*b* are located relatively close to the working surfaces while using a corner sanding attachment such as sanding portion 24. Additionally, the positions of sanding portion 24 and vacuum portion 30 provide a spatially compact configuration of components that both sand and recover debris from a working surface. It should be appreciated that an alternative sanding system may include a sanding portion moves to completely cover (and/or seal) and uncover vacuum portion inlets. It should also be appreciated that the advantages of the invention may be achieved when the cyclical motion of sanding portion 24 moves to at least partially cover and at least partially uncover inlets 34*a*, 34*b*.

Alignment heel 36 includes surface guides 60, 62 to provide sanding system 20 with a second area of contact with wall 22 that is spaced from and aligned with sanding portion 24 (the first area of contact). Outboard portions of alignment heel 36 and sanding portion 24 terminate in common contact planes. That is, the outer sides 60*a*, 62*a* of each guide 60, 62 are coplanar, in respective contact planes, with respective contact portions 38*a*, 40*a* of sanding portion 24. Guides 60, 62 are also made of or covered with a smooth and/or soft material, such as felt, to allow them to slide along a working surface without scratching, damaging, or otherwise substantially removing material from working surface, but that also provides guides 60, 62 with a suitable level of friction to prevent sudden movements or inadvertent slipping of guides 60, 62 relative to the working surface during the sanding process. As a result, alignment heel 36 promotes proper alignment and uniform contact between sanding portion 24 and wall 22 by both stabilizing and constraining undesired movements of sanding portion 24. As discussed above, a sanding portion may be equipped with backing pads having varying geometric profiles that are designed for sanding surface areas other than an internal corner. Similarly, an alignment heel may also be equipped with surface guides having geometry that varies depending on the particular backing pads being used for sanding such that any given combination of backing pads/surface guides each terminate in an outboard direction in one or more common contact planes.

Accordingly, the sanding system of the present invention provides an effective way to sand a working surface while simultaneously vacuuming away sanding dust or debris, and maintaining desired alignment with the surface(s) being sanded. A sanding portion is attached to a power tool that reciprocates or moves the sanding portion to sand the working surface. The sanding portion moves relative to a vacuum portion during the sanding process to alternatively cover and uncover a pair of spaced apart inlets that are used to recover debris from the working surface. An alignment heel is spaced apart from and aligned with the sanding portion to promote stability and uniform contact pressure between the sanding portion and the working surface during the sanding process.

Changes and modifications in the specifically described embodiments may be carried out without departing from the principles of the present invention, which is intended to be limited only by the scope of the appended claims, as interpreted according to the principles of patent law including the doctrine of equivalents.

The invention claimed is:

1. A sanding system for sanding a working surface, said sanding system comprising:

a vacuum portion comprising longitudinally spaced-apart first and second inlets configured to recover debris from the working surface; and a sanding portion longitudinally movably coupled to said vacuum portion, wherein said sanding portion is configured for securing to a longitudinally reciprocating part of a power tool;

wherein said sanding portion is reciprocally movable along said vacuum portion by the reciprocating part of the power tool, between a first position in which said first inlet is at least partially covered by said sanding portion and said second inlet is at least partially uncovered, and a second position in which said second inlet is at least partially covered by said sanding portion and said first inlet is at least partially uncovered.

2. The sanding system of claim 1, wherein said sanding portion comprises a pair of backing surfaces oriented at an angle relative to one another and connected along a longitudinal axis.

3. The sanding system of claim 2, wherein said backing surfaces are oriented at an angle of 90 degrees relative to one another.

4. The sanding system of claim 3, wherein said backing surfaces further comprise tapered end portions oriented at an angle of less than 90 degrees relative to one another.

5. The sanding system of claim 1, wherein said first and second inlets are located entirely inboard of said sanding portion in latitudinal and transverse directions.

6. The sanding system of claim 1, further comprising an attachment, wherein said vacuum portion further defines a through-hole, and wherein said attachment protrudes through said through-hole to couple said sanding portion to a reciprocating part of a reciprocating power tool.

7. The sanding system of claim 6, wherein said vacuum portion is securable to a non-reciprocating part of the reciprocating power tool.

8. The sanding system of claim 1, further comprising an alignment heel spaced apart from said sanding portion and said vacuum portion, and configured to slidably contact the working surface substantially without removing material from the working surface, wherein said alignment heel and said sanding portion each terminate in a common contact plane, said alignment heel and said sanding portion share a common longitudinal axis, said alignment heel and said vacuum portion are securable to a non-reciprocating part of a reciprocating power tool, and said sanding portion is securable to a reciprocating part of the reciprocating power tool.

9. The sanding system of claim 8, wherein said alignment heel comprises a guide tip and a pair of surface guides oriented at a guide angle relative to one another and connected at said guide tip along the common longitudinal axis, wherein said sanding portion comprises a sanding tip and a pair of backing surfaces oriented at a sanding angle relative to one another and connected at said sanding tip along the common longitudinal axis, and wherein said guide angle and said sanding angle are equal.

10. The sanding system of claim 9, wherein said guide angle and sanding angle are each 90 degrees.

11. The sanding system of claim 1, wherein said vacuum portion defines the entireties of said first and second inlets, and wherein said sanding portion is reciprocally operable to at least partially overly said first and second inlets in an alternating manner.

12. The sanding system of claim 1, wherein when said sanding portion is in the first position said sanding portion overlies at least a majority of said first inlet and exposes at least a majority of said second inlet, and when said sanding portion is in the second position said sanding portion overlies at least a majority of said second inlet and exposes at least a majority of said first inlet.

13. A sanding system for a reciprocating power tool, said sanding system comprising:

a vacuum portion defining a through-hole, said vacuum portion securable to a non-reciprocating part of the reciprocating power tool and comprising spaced-apart first and second inlets configured to recover debris from a working surface;

a sanding portion reciprocally coupled to said vacuum portion and comprising a sanding tip and a pair of backing surfaces cooperating to define a sanding angle and connected at said sanding tip along a common longitudinal axis, said sanding portion configured to reciprocate between a first position in which said first inlet is substantially covered by said sanding portion and said second inlet is substantially uncovered, and a second position in which said second inlet is substantially covered by said sanding portion and said first inlet is substantially uncovered;

an attachment protruding though said through-hole to couple said sanding portion to a reciprocating part of the reciprocating power tool; and an alignment heel securable to the non-reciprocating part of the reciprocating power tool and spaced apart from said sanding portion and said vacuum portion, said alignment heel comprising a guide tip and a pair of surface guides configured to slidably contact the working surface substantially without removing material from the working surface, said surface guides cooperating to define a guide angle and connected at said guide tip along the common longitudinal axis;

wherein said sanding angle and said guide angle are equal; and wherein said first and second inlets are located entirely inboard of said backing surfaces in latitudinal and transverse directions.

14. The sanding system of claim 13, wherein the common longitudinal axis lies in a latitudinal plane that passes through said first and second inlets.

15. The sanding system of claim 13, wherein:

said vacuum portion further comprises a connector coupled to a rigid elongated duct;

said connector comprises a U-shaped shoulder and an adjustable strap;

said shoulder is configured to receive the non-reciprocating part of the power tool;

said strap is configured to selectively secure the non-reciprocating part of the power tool to said shoulder; and said duct is securable to a vacuum tube.

16. The sanding system of claim 13, wherein said backing surfaces further comprise tapered end portions oriented at an angle of less than 90 degrees relative to one another, and wherein said sanding angle and said guide angle are each 90 degrees.

17. The sanding system of claim 11, wherein when said sanding portion is in the first position said sanding portion overlies at least a majority of said first inlet and exposes at least a majority of said second inlet, and when said sanding portion is in the second position said sanding portion overlies at least a majority of said second inlet and exposes at least a majority of said first inlet.

* * * * *